United States Patent [19]

Larsson L. Kenneth

[11] Patent Number: 4,968,068

[45] Date of Patent: Nov. 6, 1990

[54] THREAD COUPLING FOR DRILL STRING MEMBERS

[75] Inventor: Larsson L. Kenneth, Sandviken, Sweden

[73] Assignee: Sandvik AB, Sandviken, Sweden

[21] Appl. No.: 376,573

[22] Filed: Jul. 7, 1989

[30] Foreign Application Priority Data

Jul. 8, 1988 [SE] Sweden ..... 8802554

[51] Int. Cl.[5] ..... F16L 15/00

[52] U.S. Cl. ..... 285/390; 285/417; 285/906; 403/343; 29/434

[58] Field of Search ..... 285/333, 334, 390; 403/343; 29/434

[56] References Cited

U.S. PATENT DOCUMENTS 1,477,855 12/1923 Thurston .
1,959,919 5/1934 Jones .
3,537,738 11/1970 Fischer et al. .
3,645,570 2/1972 Johansson et al. .
4,548,431 10/1985 Hall et al. ..... 285/390 X
4,687,368 8/1987 Eklof et al. ..... 285/334 X
4,707,001 11/1987 Johnson ..... 285/334 X

FOREIGN PATENT DOCUMENTS 532495 4/1958 Italy ..... 285/333
8704487 7/1987 PCT Int'l Appl. .

*Primary Examiner*—Dave W. Arola
*Attorney, Agent, or Firm*—Burns, Doane, Swecker & Mathis

[57] ABSTRACT

A thread coupling includes at least one male thread and one female tread. The male thread is arranged upon a spigot that constitutes an integral part of one drill string element. The one drill string element is provided with a contact surface spaced from the free end of the spigot. The female thread is a part of a coupling sleeve that is connected to another drill string element. The coupling sleeve is provided with an internal stop surface. The contact surface of the one drill string element contacts a free end of the sleeve, but the free end of the spigot is spaced slightly from the stop surface by a gap which is eventually eliminated after the threads have become worn-in. The gap is greater than zero, but no greater than 1 mm.

7 Claims, 1 Drawing Sheet

THREAD COUPLING FOR DRILL STRING MEMBERS

BACKGROUND OF THE INVENTION

The present invention relates to a thread coupling for use in a drill string adapted for well drilling in earth and rock formations. The coupling includes at least one male thread and one female thread. The male thread is arranged upon a spigot that constitutes an integral part of a first drill string element. That drill string element includes a radial shoulder located at the inner end of the spigot, the shoulder having a contact surface directed towards the free end of the spigot. The female thread is connected to a second drill string element with an internal or bottom stop surface being provided at the inner end, or bottom, of the female thread.

Contact between the free end of the spigot and the bottom stop surface is hereinafter referred to as a "bottom stop", and contact between the radial shoulder and the free end of the second drill string element is hereinafter referred to as a "shoulder stop".

In a conventional thread coupling between two elements of a rock drilling string for percussive drilling, a bottom stop is normally used, e.g., see Fischer et al U.S. Pat. No. 3,537,738 disclosing coupling sleeves integral with one of the drill rods and Johansson et al U.S. Pat. No. 3,645,570 disclosing a separate coupling sleeve.

In cases where a female thread is formed in a coupling sleeve which is integral with the second drill string element, a bottom stop occurs as the free end of the spigot of one drill rod abuts the bottom of the integral coupling sleeve. In the case where the sleeve is separately attached to the second drill string element, a bottom stop occurs when the ends of the two drill rods abut each other within the sleeve.

For a coupling between a drill rod and a drill bit for percussive drilling, bottom stops are normally used. This is exemplified in Jones U.S. Pat. No. 1,959,919.

So-called shoulder stops in thread couplings between two elements in a rock drilling equipment for percussive drilling are also known. This is exemplified in Thurston U.S. Pat. No. 1,477,855. In this type of thread coupling a deterioration of the energy transfer can occur and also extensive local stresses can be present at the shoulder stop and/or at the bottom of the internal thread.

PCT Published Application No. WO87/04487 filed Jan. 14, 1987, discloses a percussive drill wherein a spigot of a drill rod engages a bottom of a female thread in a drill bit to form a bottom stop therewith. The shoulder on the drill rod is disclosed as being spaced from the free end of the female thread. In practice, however, that spacing, or gap, is gradually eliminated, whereupon there is created a shoulder stop in combination with the bottom stop.

This latter condition, i.e., wherein both a bottom stop and a shoulder stop are formed, is the most ideal condition for the transference of forces from one drill string element to the other. However, it is most difficult, due to normal manufacturing tolerances, to be able to manufacture the threaded coupling so that such an ideal condition exists immediately upon manufacture. Thus, for example, it may occur that the dimensions of the male and female thread components result in the formation of only a bottom stop, as in the above-referenced PCT Application for example. In such a case, however, it may occur that the threads are damaged as the result of bending moments applied to the drill string elements during a drilling operation, such damage being particularly apt to occur to the male threads.

SUMMARY OF THE INVENTION

The present inventor has discovered, however, that such damage is less likely to occur if the sole stop function occurs as a result of a shoulder stop rather than as a bottom stop. The reason for this is that the shoulder stop is located farther radially from the longitudinal axis of the thread coupling and thus creates stronger force couples which resist bending of the drill string elements Therefore, the present invention involves a thread coupling wherein there is assuredly provided a shoulder contact. This is achieved by a method of making the threaded coupling wherein the manufacturing tolerance for a gap at the bottom stop, i.e., between the free end of the spigot and the bottom of the female thread is a positive tolerance of zero to 1 mm. Consequently, it is possible that the manufacturing step will result in the presence of both a shoulder stop and a bottom stop, but will assuredly result in the presence of a shoulder stop. Furthermore, since the maximum size of the gap is about 1 mm, it is assured that the gap will be eliminated by wearing-in of the threads before the useful life of the thread coupling has expired, i.e., the gap will be eliminated when no more than 20 percent of the useful thread life has expired.

BRIEF DESCRIPTION OF THE DRAWING

Below a embodiment of the invention will be described with reference to the enclosed drawing in which.

DETAILED DESCRIPTION OF PREFERRED EMBODIMENT OF THE INVENTION

Figure 1:
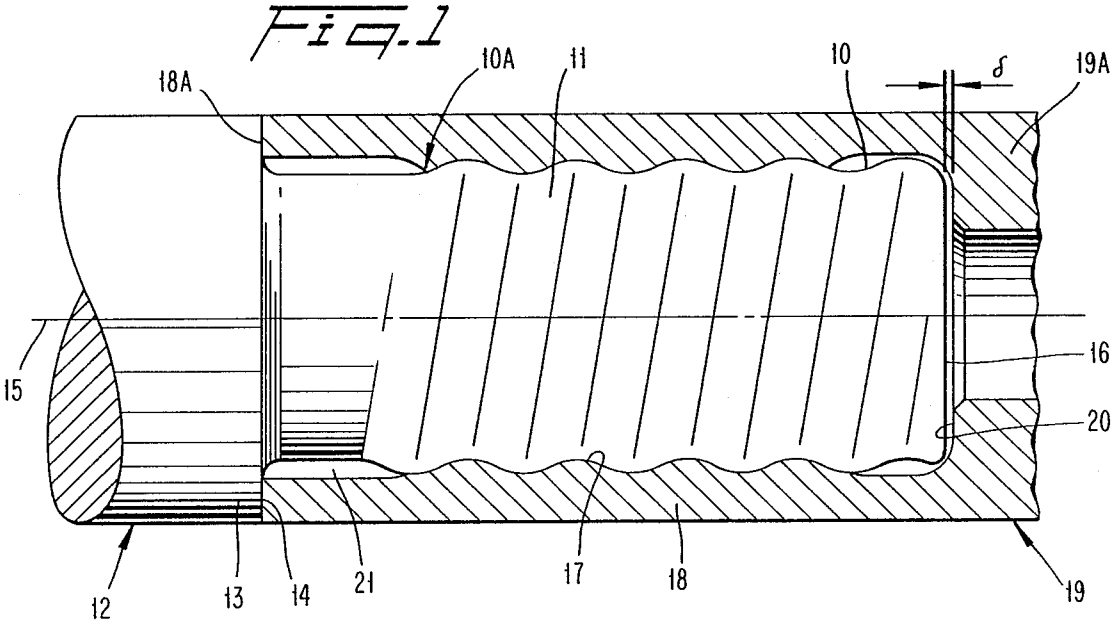
FIG. 1 is a schematic, partly longitudinally sectioned view of a thread coupling according to the invention.

A thread coupling according to the invention includes a male cylindrical thread 10 (FIG. 1) that is provided on a spigot 11 which constitutes an integral part of a drill rod element 12 for percussive drilling. At the inner end of the spigot 11 a body portion of drill rod 12 is provided with a shoulder 13 that has a planar contact surface 14 directed towards the free end of the spigot 11. The contact surface 14 has an extension perpendicular to a longitudinal center axis 15 of the drill rod 12.

The free end of the spigot 11 has the shape of a planar end surface 16 that has an extension perpendicular to the center axis 15.

The thread coupling includes a female cylindrical thread 17 provided in a sleeve 18 which constitutes an integral part of a body portion 19A of another drill rod element 19. Inside the sleeve 18, the other drill rod has a planar bottom surface 20 that has an extension perpendicular to the longitudinal center axis 15 of the other drill rod 19, the longitudinal center axis in the figure, coinciding with the center axis of the first drill rod 12.

The elements 12 and 19 are formed by metal casing operations.

From FIG. 1 it is evident that in the thread coupling according to the present invention the contact surface 14 always contacts the free end 18A of the sleeve 18, i.e., a so-called shoulder stop is established.

It is also evident from FIG. 1 that between the end surface 16 of the spigot 11 and the bottom surface 20 inside the sleeve 18 there is an initial gap or play $\delta$ that nominally is chosen to be zero but with a positive manufacturing tolerance in the magnitude of 1 mm. That is, the manufacturing tolerance of the gap is chosen to be either zero or a positive value up to 1 mm. In other words, the tolerance is chosen so as not to be negative, so that the gap is either zero or positively greater than zero, but not positively greater than about 1 mm.

After a certain time of use, at the most within 20% of the length of life for the thread coupling, this maximum 1 mm play will be eliminated due to wearing-in of the thread coupling and contact surfaces 14, 18A; consequently, the thread coupling according to the invention will achieve both shoulder stop and bottom stop. During the wearing-in, the occurrence of bending moments in the spigot will be minimized because the spigot can approach the bottom of the sleeve From FIG. 1 it is also evident that the male thread 10 terminates at a location 10A spaced longitudinally from the contact surface 14 to define on the spigot a thread-free zone between the contact surface and the location 10A. Likewise, the female thread terminates at about the same location to define on the sleeve a thread-free zone between the location 10A and the free end 18A. Those thread free zones are radially superimposed to form a thread clearance 21 for evening out bending stresses from manufacturing inaccuracies of the shoulder or the threads In addition, the clearance 21 evens out torsion stresses and stresses from shock or tension waves that pass through the thread coupling.

Figure 2:
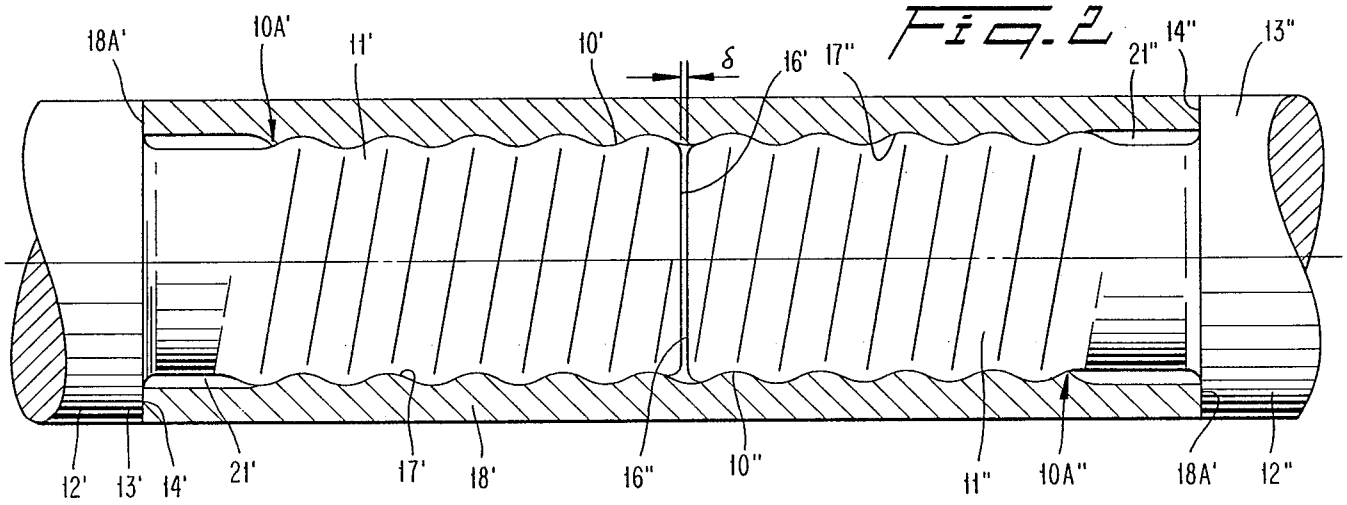
FIG. 2 is a view similar to FIG. 2 of another embodiment of the invention.

In another embodiment of the invention, depicted in FIG. 2, the stop surface 20' is defined by a body portion of a drill string element 19' to which a separate sleeve is threadedly attached. Elements of FIG. 2 which are similar to those of FIG. 1 have been provided with the same reference numerals containing a prime symbol. Thus, the present invention is applicable to arrangements wherein the coupling sleeve is integral with, or detachably coupled to one of the drill string elements.

The invention is in no way restricted to the embodiment described above. For example, the principles of the invention can be used also in a thread coupling between a shank adapter and the first drill rod.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A threadedly coupled arrangement of percussion drill spring elements for the transmission of percussive impact forces, comprising:

a first percussion drill string element carrying:

a coupling sleeve having a female cylindrical coupling thread, and an internal stop surface disposed longitudinally from a free end of said sleeve, and a second percussion drill string element including:

a spigot disposed within said sleeve and having a male cylindrical coupling thread coupled to said female thread for transmitting percussive impact forces therebetween, and a stop shoulder defining a contact surface spaced longitudinally from a free end of said spigot and abutting against said free end of said sleeve, said free end of said spigot being spaced from said internal stop surface by a gap greater than zero and no greater than about 1 mm, the gap adapted to be eliminated after a wearing-in of said threads.

2. An arrangement according to claim 1, wherein said male thread terminates at a first location spaced longitudinally from said contact surface to define a first thread-free zone between said stop surface and said first location, said female thread terminates at a second location spaced longitudinally from said free end of said sleeve to define a second thread-free zone between said second location and said last-named free end, said first and second thread-free zones forming a thread clearance.

3. An arrangement according to claim 1, wherein said first drill string element includes a body portion, said sleeve being integrally formed with said body portion.

4. An arrangement according to claim 3, wherein said internal stop surface constitutes a transition surface between said body portion and said sleeve.

5. An arrangement according to claim 1, wherein said first drill string element includes a body portion, said sleeve being detachable from said body portion, said stop surface being integral with said body portion.

6. An arrangement according to claim 1, wherein said gap is dimensioned so as to be eliminated when no more than twenty percent of the useful life of said threads have expired.

7. A method of making a percussion drill string arrangement for the transmission of percussive impact forces, comprising first and second percussion drill string elements wherein said first drill string element carries a coupling sleeve having a female cylindrical coupling thread, and an internal stop surface disposed longitudinally from a free end of said sleeve, said second drill string element includes a spigot disposed within said sleeve and having a male cylindrical coupling thread coupled to said female thread for transmitting percussive impact forces therebetween, and a stop shoulder defining a contact surface spaced longitudinally from a free end of said spigot and abutting against said free end of said sleeve, said method including the step of forming said first and second elements such that said free end of said spigot is spaced from said internal stop surface forming a gap therebetween and the manufacturing tolerance of said gap is greater than zero to about 1 mm to assure that said stop shoulder abuts said free end of said sleeve, and that said gap is eliminated after a wearing-in of said threads.

* * * * *